US009559422B2

(12) United States Patent
Wong et al.

(10) Patent No.: US 9,559,422 B2
(45) Date of Patent: Jan. 31, 2017

(54) COMMUNICATION DEVICE AND METHOD FOR DESIGNING MULTI-ANTENNA SYSTEM THEREOF

(71) Applicants: Industrial Technology Research Institute, Hsinchu (TW); National Sun Yat-sen University, Kaohsiung (TW)

(72) Inventors: Kin-Lu Wong, Kaohsiung (TW); Yeh-Chun Kao, Taoyuan County (TW); Po-Wei Lin, Taichung (TW); Wei-Yu Li, Yilan County (TW)

(73) Assignees: Industrial Technology Research Institute, Hsinchu (TW); National Sun Yat-sen University, Kaohsiung (TW)

( * ) Notice: Subject to any disclaimer, the term of this patent is extended or adjusted under 35 U.S.C. 154(b) by 414 days.

(21) Appl. No.: 14/460,377

(22) Filed: Aug. 15, 2014

(65) Prior Publication Data

US 2015/0311588 A1 Oct. 29, 2015

(30) Foreign Application Priority Data

Apr. 23, 2014 (TW) ..... 103114701 A

(51) Int. Cl.
*H01Q 7/00* (2006.01)
*H01Q 13/10* (2006.01)
(Continued)

(52) U.S. Cl.
CPC ..... *H01Q 7/00* (2013.01); *H01Q 9/14* (2013.01); *H01Q 13/10* (2013.01); *H01Q 21/20* (2013.01); *H01Q 21/30* (2013.01)

(58) Field of Classification Search
CPC ..... H01Q 7/00; H01Q 9/04; H01Q 9/06; H01Q 9/14; H01Q 9/145; H01Q 13/10; H01Q 13/103; H01Q 13/106; H01Q 21/06; H01Q 21/20; H01Q 21/30; H01Q 3/24; H01Q 9/0407; H01Q 1/36; H01Q 1/38; H01Q 13/18; H01Q 21/28
See application file for complete search history.

(56) References Cited

U.S. PATENT DOCUMENTS 4,721,960 A 1/1988 Lait
5,543,806 A 8/1996 Wilkinson
(Continued)

FOREIGN PATENT DOCUMENTS

TW 200926518 6/2009
TW 201042826 12/2010
(Continued)

OTHER PUBLICATIONS

Chi et al., "Compact Multiband Folded Loop Chip Antenna for Small-Size Mobile Phone," IEEE Transactions on Antennas and Propagation, Dec. 2008, pp. 3797-3803.
(Continued)

*Primary Examiner* — Bernarr Gregory
(74) *Attorney, Agent, or Firm* — Jianq Chyun IP Office

(57) ABSTRACT

The disclosure provides a communication device. The communication device includes a ground conductor portion and a multi-antenna system. The multi-antenna system includes at least a first and a second resonant portion, each of which is disposed on the corresponding radiating edge of the ground conductor portion. Each of the resonant portions may have a loop resonant structure or may have an open-slot resonant structure, and has a resonant path. The electrically coupling portion makes the length of the resonant path less than or equal to 0.18 times the wavelength of the lowest operating frequency of the multi-antenna system, and thereby excites the corresponding radiating edge and forms a strong surface current distribution, and generates an effective radiating energy and at least one resonant mode, in
(Continued)

which the effective radiating energy has a corresponding strongest radiation direction.

20 Claims, 10 Drawing Sheets

(51) Int. Cl.

| | |
|---|---|
| ***H01Q 21/30*** | (2006.01) |
| ***H01Q 9/14*** | (2006.01) |
| ***H01Q 21/20*** | (2006.01) |
| *H01Q 13/00* | (2006.01) |
| *H01Q 21/00* | (2006.01) |

(56) References Cited

U.S. PATENT DOCUMENTS

| | | | | |
|---|---|---|---|---|
| 5,969,689 | A | 10/1999 | Martek et al. | |
| 6,211,830 | B1 | 4/2001 | Monma et al. | |
| 6,366,254 | B1 | 4/2002 | Sievenpiper et al. | |
| 6,459,413 | B1 | 10/2002 | Tseng et al. | |
| 6,515,635 | B2 | 2/2003 | Chiang et al. | |
| 6,611,230 | B2 | 8/2003 | Phelan | |
| 6,876,331 | B2 | 4/2005 | Chiang et al. | |
| 6,891,510 | B2 * | 5/2005 | Le Bolzer | H01Q 21/30 343/700 MS |
| 6,900,775 | B2 | 5/2005 | Shapira | |
| 6,972,729 | B2 | 12/2005 | Wang | |
| 6,987,493 | B2 | 1/2006 | Chen | |
| 7,013,165 | B2 | 3/2006 | Yoon et al. | |
| 7,034,761 | B2 | 4/2006 | Chiang et al. | |
| 7,068,324 | B2 | 6/2006 | Englert | |
| 7,084,816 | B2 | 8/2006 | Watanabe | |
| 7,126,541 | B2 | 10/2006 | Mohamadi | |
| 7,164,387 | B2 * | 1/2007 | Sievenpiper | H01Q 9/14 343/700 MS |
| 7,180,464 | B2 | 2/2007 | Chiang et al. | |
| 7,180,465 | B2 | 2/2007 | Lynch et al. | |
| 7,215,296 | B2 | 5/2007 | Abramov et al. | |
| 7,268,738 | B2 | 9/2007 | Gothard et al. | |
| 7,280,848 | B2 | 10/2007 | Hoppenstein | |
| 7,292,198 | B2 | 11/2007 | Shtrom et al. | |
| 7,403,160 | B2 | 7/2008 | Chiang et al. | |
| 7,498,987 | B2 * | 3/2009 | Svigelj | H01Q 1/38 343/700 MS |
| 7,511,680 | B2 | 3/2009 | Shtrom et al. | |
| 7,525,486 | B2 | 4/2009 | Shtrom et al. | |
| 7,525,499 | B2 * | 4/2009 | Kanno | H01Q 1/38 343/767 |
| 7,535,429 | B2 * | 5/2009 | Kanno | H01Q 13/10 343/767 |
| 7,541,999 | B2 * | 6/2009 | Matsushita | H01Q 13/10 343/770 |
| 7,652,632 | B2 | 1/2010 | Shtrom | |
| 7,768,455 | B2 | 8/2010 | Jung et al. | |
| 7,812,783 | B2 * | 10/2010 | Mak | H01Q 3/24 343/700 MS |
| 7,864,119 | B2 | 1/2011 | Shtrom et al. | |
| 7,893,882 | B2 | 2/2011 | Shtrom | |
| 7,911,402 | B2 | 3/2011 | Rowson et al. | |
| 7,956,815 | B2 | 6/2011 | Ohira et al. | |
| 7,973,726 | B2 * | 7/2011 | Tseng | H01Q 21/28 343/700 MS |
| 8,159,398 | B2 * | 4/2012 | Su | H01Q 21/28 343/700 MS |
| 8,174,454 | B2 * | 5/2012 | Mayer | H01Q 7/00 343/725 |
| 8,203,484 | B2 | 6/2012 | Chu et al. | |
| 8,619,001 | B2 * | 12/2013 | Wakabayashi | H01Q 21/28 343/860 |
| 8,860,619 | B2 * | 10/2014 | Nysen | H01Q 13/18 343/702 |
| 9,088,067 | B2 * | 7/2015 | Wong | H01Q 9/04 |
| 2010/0156726 | A1 | 6/2010 | Montgomery et al. | |
| 2010/0156745 | A1 | 6/2010 | Andrenko et al. | |
| 2010/0295743 | A1 | 11/2010 | Pu et al. | |
| 2010/0315313 | A1 | 12/2010 | Wu | |
| 2011/0102281 | A1 | 5/2011 | Su | |
| 2011/0122027 | A1 | 5/2011 | Wong et al. | |
| 2011/0241953 | A1 | 10/2011 | Su | |
| 2011/0254743 | A1 | 10/2011 | Kobayashi et al. | |
| 2012/0001815 | A1 | 1/2012 | Wong et al. | |
| 2013/0002501 | A1 | 1/2013 | Li et al. | |
| 2013/0257674 | A1 | 10/2013 | Li et al. | |
| 2014/0015729 | A1 * | 1/2014 | Uejima | H01Q 9/14 343/850 |
| 2014/0266968 | A1 * | 9/2014 | Wong | H01Q 9/14 343/876 |

FOREIGN PATENT DOCUMENTS

| | | |
|---|---|---|
| TW | I334241 | 12/2010 |
| TW | 201342708 | 10/2013 |

OTHER PUBLICATIONS

Chen et al., "A Decoupling Technique for Increasing the Port Isolation Between Two Strongly Coupled Antennas," IEEE Transactions on Antennas and Propagation, Dec. 2008, pp. 3650-3658.

Stutzman and Thiele, "Antenna Theory and Design," John Wiley & Sons Inc., May 2012, pp. 273-311.

Sutinjo et al., "An Octave Band Switched Parasitic Beam-Steering Array," IEEE Antennas and Wireless Propagation Letters, 2007, pp. 211-214.

Pu et al., "A Novel Antenna Pattern Switching Mechanism for WLAN Application," 2011 IEEE International Symposium on Antennas and Propagation (APSURSI), Jul. 3-8, 2011, pp. 2051-2054.

Kamarudin et al., "Switched Beam Antenna Array with Parasitic Elements," Progress in Electromagnetics Research B, 2009, pp. 187-201.

Sun et al, "Fast Beamforming of Electronically Steerable Parasitic Array Radiator Antennas: Theory and Experiment," IEEE Transactions on Antennas and Propagation, Jul. 2004, pp. 1819-1832.

Nakano et al., "A Small Steerable-Beam Antenna," International Symposium on Antennas and Propagation, Aug. 2006, pp. 1-6.

Kamarudin et al., Abstract of "Disc-loaded monopole antenna array for switched beam control," Electronics Letters, Jan. 19, 2006, pp. 66-68.

Schlub et al., "Switched Parasitic Antenna on a Finite Ground Plane With Conductive Sleeve," IEEE Transactions on Antennas and Propagation, May 2004, pp. 1343-1347.

Wong et al.,"Decoupled WWAN/LTE antennas with asn isolation ring strip embedded therebetween for smartphone application," Microwave Opt. Technol. Lett., Jul. 2013, pp. 1470-1476.

Kang et al, "Isolation improvement of 2.4/52/5.8 GHz WLAN Internal laptop computer antennas using dual-band strip resonator as a wavetrap," Microwave Opt. Technol. Lett., Jan. 2010, pp. 58-64.

"Office Action of Taiwan Counterpart Application", issued on Dec. 22, 2015, p. 1-p. 4.

* cited by examiner

COMMUNICATION DEVICE AND METHOD FOR DESIGNING MULTI-ANTENNA SYSTEM THEREOF

CROSS-REFERENCE TO RELATED APPLICATION

This application claims the priority benefit of Taiwan application serial no. 103114701, filed on Apr. 23, 2014. The entirety of the above-mentioned patent application is hereby incorporated by reference herein and made a part of this specification.

BACKGROUND

Technical Field

The disclosure relates to a communication device and a method for designing a multi-antenna system thereof.

Description of Related Art

Smart antenna design techniques capable of reconfiguring antenna patterns and the directions of radiation beams in response to environmental variations of the wireless communication channels are very important research topics in the field of antenna designs. If the antenna patterns and the directions of radiation beams can be steered toward the directions of transmitting or receiving energies of communication signals, the signal quality received by a receiver may be greatly improved, and the effective distance or coverage range of transmitters could also be increased.

In the prior pattern-switchable antenna techniques, if a lower frequency band is chosen for communication operations, the required overall physical size of antenna elements for multi-antenna systems would be too large for practical applications. For example, the operating wavelength of 700 MHz band for Long Term Evolution (LTE) system would be approximately 430 mm. Therefore, it's not an easy task for integrating several antenna elements for LTE700 operations into a single communication device simultaneously. On the other hands, prior active antenna array techniques would require to design feeding networks with high complexity and cost. For other prior pattern reconfigurable multi-antenna techniques, although complexity or cost of antenna feeding networks could also be reduced, these used multi-antenna elements would still occupy large areas when applied in lower frequency bands.

SUMMARY

The disclosure provides a communication device and a method for designing a multi-antenna system thereof. According to an embodiment, the disclosure provides a communication device. The communication device includes at least a ground conductor portion and a multi-antenna system. The ground conductor portion has at least a first radiating edge and a second radiating edge. The multi-antenna system includes at least a first resonant portion, a second resonant portion, a first control circuit, and a second control circuit. The first resonant portion is disposed on the first radiating edge of the ground conductor portion. The first resonant portion includes a first electrically coupling portion and a first switch, in which the first resonant portion has a loop resonant structure or an open-slot resonant structure. Moreover, the first resonant portion has a first resonant path, and the first switch is disposed on the first resonant path. The first electrically coupling portion makes the length of the first resonant path less than or equal to 0.18 times the wavelength of the lowest operating frequency of the multi-antenna system, thereby exciting the first radiating edge to form a strong surface current distribution, and generating a first effective radiating energy and at least one first resonant mode covering at least one first operating band, the first effective radiating energy generated having a first strongest radiation direction. The second resonant portion is disposed on the second radiating edge of the ground conductor portion. The second resonant portion includes a second electrically coupling portion and a second switch, in which the second resonant portion has a loop resonant structure or an open-slot resonant structure. Moreover, the second resonant portion has a second resonant path, and the second switch is disposed on the second resonant path. The second electrically coupling portion makes the length of the second resonant path less than or equal to 0.18 times the wavelength of the lowest operating frequency of the multi-antenna system, thereby exciting the second radiating edge to form a strong surface current distribution, and generating a second effective radiating energy and at least one second resonant mode covering at least the first operating band, the second effective radiating energy generated having a second strongest radiation direction. The first control circuit is respectively and electrically coupled to the first resonant portion and the second resonant portion through a plurality of signal lines. The first control circuit switches a signal source to electrically couple to one of the first resonant portion or the second resonant portion, and generates the first strongest radiation direction or the second strongest radiation direction. Alternatively, the first control circuit controls the signal source to concurrently electrically couple to the first resonant portion and the second resonant portion, and generate a third effective radiating energy having a third strongest radiation direction. The second control circuit is respectively and electrically coupled to the first switch and the second switch through a plurality of signal lines. The second control circuit switches the first switch to a conducting state when the signal source is electrically coupled to the first resonant portion, and switches the second switch to the conducting state when the signal source is electrically coupled to the second resonant portion.

According to another embodiment, the disclosure provides a method for designing a multi-antenna system suitable for a communication device. The method includes the following steps: disposing a multi-antenna system in a communication device including a ground conductor portion, in which the ground conductor portion includes at least a first radiating edge and a second radiating edge, and the multi-antenna system includes at least a first resonant portion and a second resonant portion; disposing the first resonant portion on the first radiating edge, in which the first resonant portion has a loop resonant structure or an open-slot resonant structure, and the first resonant portion has a first resonant path, the first resonant portion including a first electrically coupling portion and a first switch, the first switch is disposed on the first resonant path, the first electrically coupling portion makes the length of the first resonant path less than or equal to 0.18 times the wavelength of the lowest operating frequency of the multi-antenna system, thereby exciting the first radiating edge to form a strong surface current distribution, and generating a first effective radiating energy and at least one first resonant mode covering at least one first operating band, and the first effective radiating energy generated has a first strongest radiation direction; disposing the second resonant portion on the second radiating edge of the ground conductor portion, in which the second resonant portion has a loop resonant structure or an open-slot resonant structure, and the second resonant portion has a second resonant path, the second resonant portion including a second electrically coupling portion and a second switch, the second switch is disposed on the second resonant path, the second electrically coupling portion makes the length of the second resonant path less than or equal to 0.18 times the wavelength of the lowest operating frequency of the multi-antenna system, thereby exciting the second radiating edge to form a strong surface current distribution, and generating a second effective radiating energy and at least one second resonant mode covering at least the first operating band, the second effective radiating energy generated having a second strongest radiation direction; disposing a first control circuit respectively and electrically coupled to the first resonant portion and the second resonant portion through a plurality of signal lines, the first control circuit switching a signal source to electrically couple to one of the first resonant portion or the second resonant portion, and generating the first strongest radiation direction or the second strongest radiation direction, or controlling the signal source to concurrently electrically couple to the first resonant portion and the second resonant portion, and generating a third effective radiating energy having a third strongest radiation direction; and disposing a second control circuit respectively and electrically coupled to the first switch and the second switch through a plurality of signal lines, the second control circuit switching the first switch to a conducting state when the signal source is electrically coupled to the first resonant portion, and switching the second switch to the conducting state when the signal source is electrically coupled to the second resonant portion.

To make the above features and advantages of the present disclosure more comprehensible, several embodiments accompanied with drawings are described in detail as follows.

DETAILED DESCRIPTION

The disclosure provides a communication device and a method for designing a multi-antenna system thereof. Many embodiments are provided to describe a communication device with switchable antenna patterns. In the communication device, miniaturized resonant portions are designed to excite adjacent edges of the ground conductor portion to generate radiating modes. Moreover, by using two different control circuits switched to excite different resonant portions, overall antenna sizes could be drastically reduced while also achieving switchable antenna patterns.

In order to design multi-antenna systems in communication devices with switchable antenna patterns in lower frequency bands, the disclosure provides a miniaturized multi-antenna architecture capable of pattern-reconfigurable functionalities. In the disclosure, miniaturized resonant structures are effectively designed to excite different adjacent edges of the ground conductor portion in the communication device to resonate and generate strong current distributions, and thereby forming different radiating modes. Moreover, two different control circuits switch the excitation of the different resonant structures on different edges located on the ground conductor portion, so as to contribute a plurality of radiation patterns on ranges of different directions. Accordingly, the overall antenna sizes would be drastically reduced while diversity radiation patterns could also be achieved. The antenna design techniques in the disclosure would be adaptable for various compact or small-size wireless communication devices, and therefore these techniques would be useful for commercial or practical applications.

In the following passages, one of the many embodiments illustrating the communication devices and the methods for designing multi-antenna systems thereof in the disclosure is used for description, although the disclosure is not limited thereto.

Figure 1A:
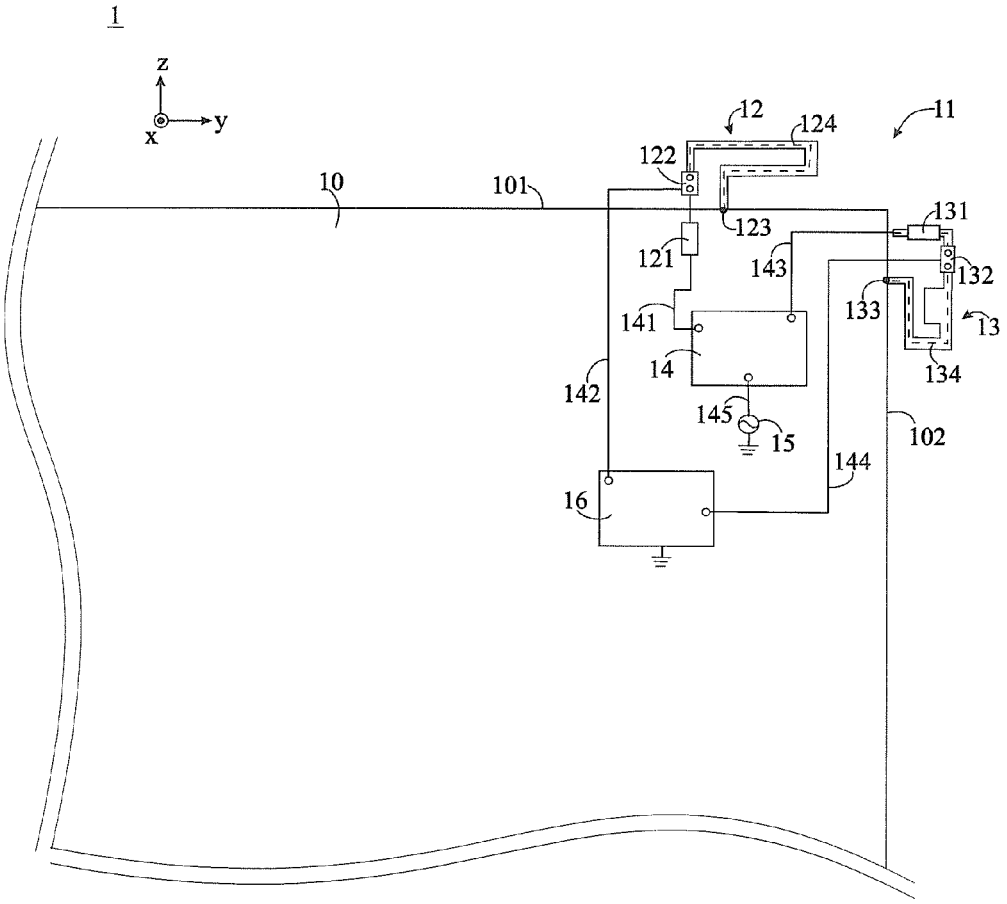
FIG. 1A is a structural schematic view of a communication device 1 and a multi-antenna system 11 thereof according to an embodiment of the disclosure.

With reference to FIG. 1A, a structural schematic view of a communication device 1 and a multi-antenna system 11 thereof according to an embodiment of the disclosure is provided. The communication device 1 includes at least a ground conductor portion 10 and the multi-antenna system 11. The ground conductor portion 10 includes at least a first radiating edge 101 and a second radiating edge 102. The multi-antenna system 11 includes at least a first resonant portion 12, a second resonant portion 13, a first control circuit 14, and a second control circuit 16. The first resonant portion 12 is disposed on the first radiating edge 101 of the ground conductor portion 10, and the first resonant portion 12 includes a first electrically coupling portion 121 and a first switch 122. The first resonant portion 12 may have a loop resonant structure having a shorting point 123 and a first resonant path 124. The first switch 122 is disposed on the first resonant path 124.

The first electrically coupling portion 121 makes the length of the first resonant path 124 less than or equal to 0.18 times the wavelength of the lowest operating frequency of the multi-antenna system 11, thereby exciting the first radiating edge 101 to form a strong surface current distribution. Moreover, a first effective radiating energy (FIG. 2A) and at least one first resonant mode 171 (FIG. 1B) covering at least one first operating band are generated, and the first effective radiating energy generated (FIG. 2A) has a first strongest radiation direction 21 (FIG. 2A). The second resonant portion 13 is disposed on the second radiating edge 102 of the ground conductor portion 10. The second resonant portion 13 includes a second electrically coupling portion 131 and a second switch 132, in which the second resonant portion 13 may have a loop resonant structure having a shorting point 133 and a second resonant path 134. The second switch 132 is disposed on the second resonant path 134. The second electrically coupling portion 131 makes the length of the second resonant path 134 less than or equal to 0.18 times the wavelength of the lowest operating frequency of the multi-antenna system 11, thereby exciting the second radiating edge 102 to form a strong surface current distribution. Moreover, a second effective radiating energy (FIG. 2B) and at least one second resonant mode 172 (FIG. 1B) covering the at least one first operating band are generated, and the second effective radiating energy generated (FIG. 2B) has a second strongest radiation direction 31 (FIG. 2B).

Furthermore, the first or second electrically coupling portion 121 or 131 includes at least one lumped capacitive element, variable capacitive element, or distributive capacitive conductor structure. In addition, the capacitive elements or capacitive conductor structures included in the first or second electrically coupling portion 121 or 131 have at least one coupling spacing, in which the gap of the coupling spacing is less than 0.01 times the wavelength of the lowest operating frequency of the multi-antenna system 11.

In the communication device 1 of the present embodiment, the first radiating edge 101 is adjacent to the second radiating edge 102, and the two edges serve as two sides of the ground conductor portion 10. The first control circuit 14 is respectively and electrically coupled to the first resonant portion 12 and the second resonant portion 13 through the signal lines 141 and 143, and the first control circuit 14 is electrically connected to a signal source 15 through a signal line 145. The first control circuit 14 may switch the signal source 15 to electrically couple to one of the first resonant portion 12 or the second resonant portion 13 and generate the first strongest radiation direction 21 (FIG. 2A) or the second strongest radiation direction 31 (FIG. 2B). Alternatively, the first control circuit 14 may control the signal source 15 to concurrently electrically couple to the first resonant portion 12 and the second resonant portion 13 and generate a third effective radiating energy having a third strongest radiation direction 41 (FIG. 2C), in which an included angle between the first and second strongest radiation directions is at least 30 degrees.

In the communication device 1 of the present embodiment, the second control circuit 16 is respectively and electrically coupled to the first switch 122 and the second switch 132 through the signal lines 142 and 144. The second control circuit 16 may switch the first switch 122 to a conducting state when the signal source 15 is electrically coupled to the first resonant portion 12, and the second control circuit 16 may switch the second switch 132 to the conducting state when the signal source 15 is electrically coupled to the second resonant portion 13. The first or second switch 122 or 132 may be a diode element, a capacitive switch element, an integrated circuit switch element, or a micro-electro-mechanical system (MEMS) switch element.

In the communication device 1 of the present embodiment, when the signal source 15 is not electrically coupled to the first resonant portion 12, the first switch 122 is in an open state, thereby effectively preventing the strong surface current distribution excited by the second resonant portion 13 on the ground conductor portion 10 to cause the first resonant portion 12 to resonate. Accordingly, the effects of the first resonant portion 12 on the second strongest radiation direction 31 (FIG. 2B) could be reduced. When the signal source 15 is not electrically coupled to the second resonant portion 13, the second switch 132 is in the open state, thereby effectively preventing the strong surface current distribution excited by the first resonant portion 12 on the ground conductor portion 10 to cause the second resonant portion 13 to resonate. Accordingly, the effects of the second resonant portion 13 on the first strongest radiation direction 21 (FIG. 2A) could be reduced, and the included angle between the first and second strongest radiation directions could be effectively increased. The signal source 15 may be a radio frequency (RF) module, a RF circuit, a RF chip, a RF filter, or a RF switch.

Figure 1B:
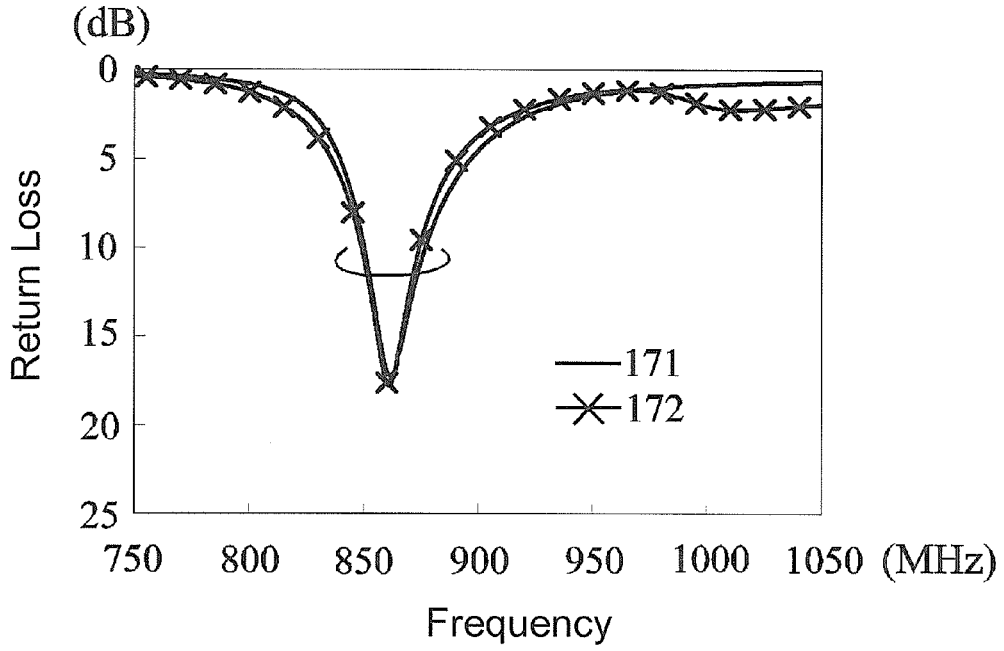
FIG. 1B is an antenna return loss diagram of the communication device 1 according to an embodiment of the disclosure.
Figure 2A:
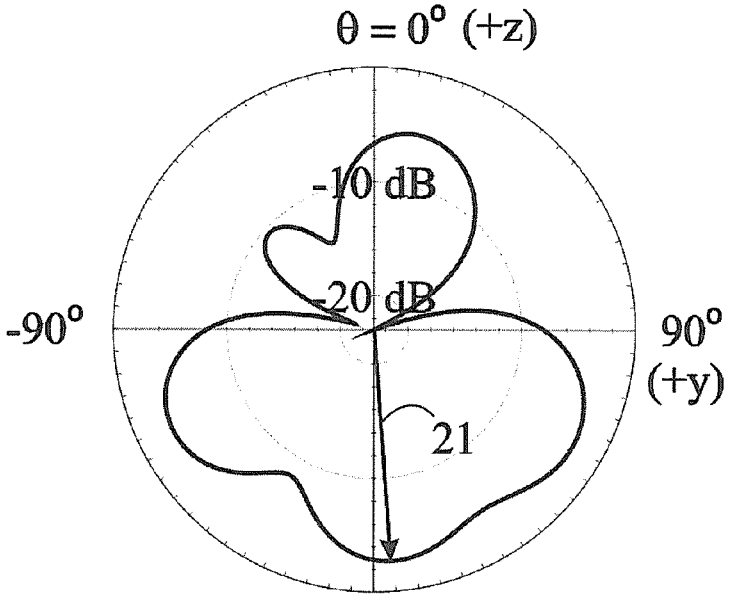
FIG. 2A is a two-dimensional (2D) pattern diagram of the first effective radiating energy in which the signal source 15 is only electrically coupled to the first resonant portion 12 according to the communication device 1 of an embodiment of the disclosure.
Figure 2B:
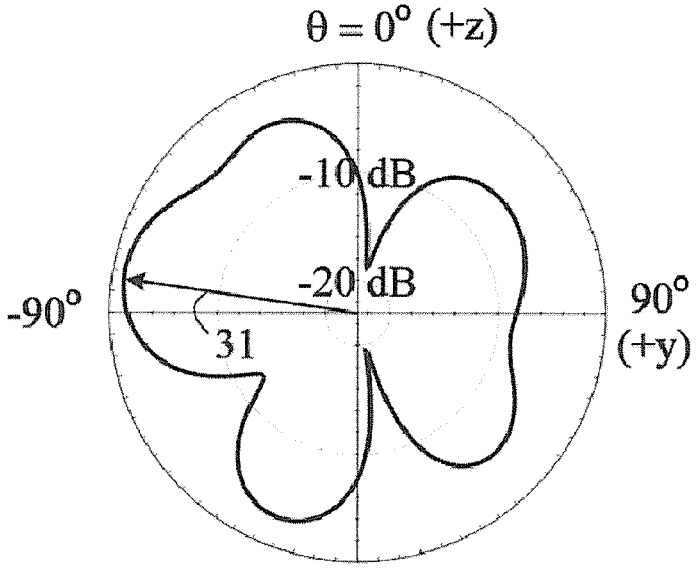
FIG. 2B is a 2D pattern diagram of the second effective radiating energy in which the signal source 15 is only electrically coupled to the second resonant portion 13 according to the communication device 1 of an embodiment of the disclosure.

With reference to FIG. 1B, an antenna return loss diagram of the communication device 1 according to an embodiment of the disclosure is provided. The first electrically coupling portion 121 may make the first resonant portion 12 excite the first radiating edge 101 to form the strong surface current distribution and to generate at least one first resonant mode 171 covering at least one first operating band. The second electrically coupling portion 131 may makes the second resonant portion 13 excite the second radiating edge 102 to form the strong surface current distribution and to generate at least one second resonant mode 172 covering the at least one first operating band. The lowest operating frequency of the communication device 1 of the present embodiment is approximately 830 MHz, and 0.18 times the wavelength of the lowest operating frequency is approximately 65 mm. The length of the first resonant path 124 is approximately 40 mm, which is approximately 0.11 times the frequency of 830 MHz. The length of the second resonant path 134 is approximately 44 mm, which is approximately 0.125 times the frequency of 830 MHz. It should be noted that the frequency of 830 MHz is merely an illustrative example, and the disclosure should not be construed as limited to the frequency of 830 MHz.

For example, in the communication device of the present embodiment, the at least one first operating band may be used to transmit or receive electromagnetic signals applied in Long Term Evolution (LTE) systems, Global System for Mobile Communications (GSM), Universal Mobile Telecommunications System (UMTS), Worldwide Interoperability for Microwave Access (WiMAX) systems, Digital Television Broadcasting (DTV) systems, Global Positioning System (GPS) systems, Wireless Wide Area Network (WWAN) systems, Wireless Local Area Network (WLAN) systems, Ultra-Wideband (UWB) systems, Wireless Personal Area Network (WPAN) systems, satellite communication systems, or other operating bands of wireless and mobile communication systems.

Figure 2C:
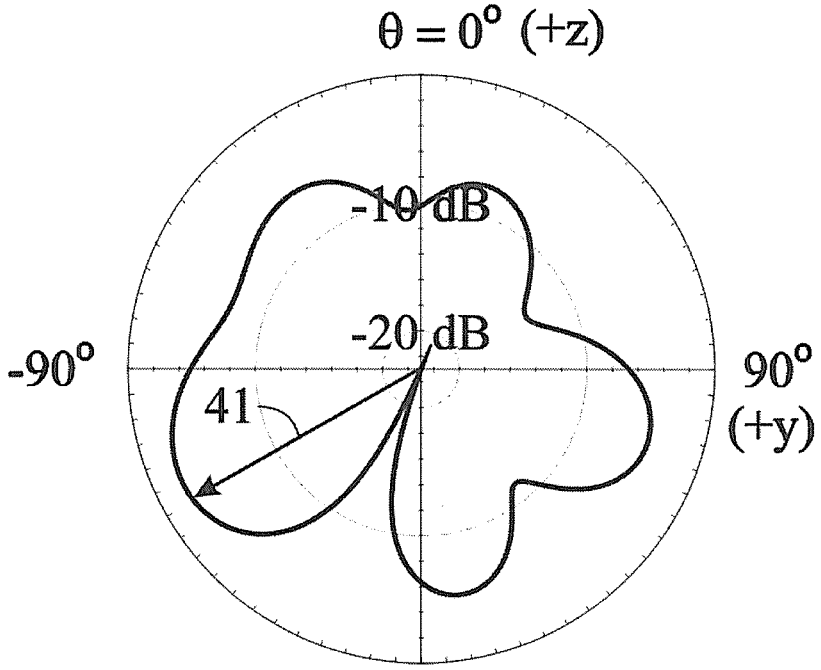
FIG. 2C is a 2D pattern diagram of the third effective radiating energy in which the signal source 15 is concurrently electrically coupled to the first and second resonant portions 12, 13 according to the communication device 1 of an embodiment of the disclosure.

With reference to FIG. 2A, a two-dimensional (2D) pattern diagram of the first effective radiating energy having the first strongest radiation direction 21 is provided, in which the signal source 15 is only electrically coupled to the first resonant portion 12 according to the communication device 1 of an embodiment of the disclosure. FIG. 2B is a 2D pattern diagram of the second effective radiating energy having the second strongest radiation direction 31, in which the signal source 15 is only electrically coupled to the second resonant portion 13 according to the communication device 1 of an embodiment of the disclosure. FIG. 2C is a 2D pattern diagram of the third effective radiating energy having the third strongest radiation direction 41, in which the signal source 15 is concurrently and electrically coupled to the first and second resonant portions 12 and 13 according to the communication device 1 of an embodiment of the disclosure. In the communication device 1 according to the present embodiment of the disclosure, an included angle between the first and second strongest radiation directions 21 and 31 is greater than 80 degrees, an included angle between the first and third strongest radiation directions 21 and 41 is greater than 60 degrees, and an included angle between the second and third strongest radiation directions 31 and 41 is greater than 45 degrees.

In the communication device 1 according to the present embodiment of the disclosure, the loop resonant structures of the first resonant portion 12 and the second resonant portion 13 are not exactly the same, and the configuration of the first electrically coupling portion 121 and the first switch 122 on the first resonant portion 12 is different from the configuration of the second electrically coupling portion 131 and the second switch 132 on the second resonant portion 13. However, since both of the first and the second electrically coupling portions 121 and 131 could make the lengths of the first and second resonant paths 124 and 134 less than or equal to 0.18 times the wavelength of the lowest operating frequency of the multi-antenna system 11, therefore, the first and second resonant portions 12 and 13 could excite the first and second radiating edges 101 and 102 to form strong surface current distributions and generate the first and second effective radiating energies. Accordingly, by using the first and second control circuits 14 and 16 to switch and adjust the electrical coupling states of the signal source 15 with the first and second resonant portions 12 and 13, the overall antenna size could be effectively reduced and switchable antenna radiation patterns could also be achieved.

Figure 3A:
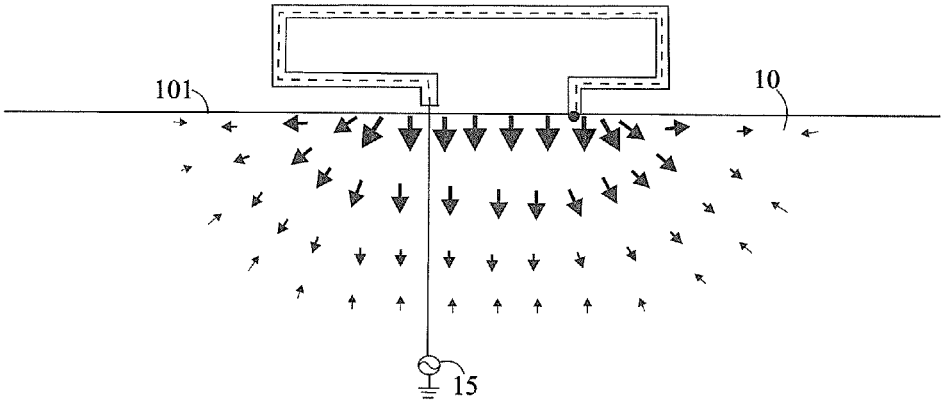
FIG. 3A is a schematic view of the radiation principles of a conventional loop antenna.

With reference to FIG. 3A, a schematic view is provided illustrating density situation of a surface current distribution excited on a ground conductor portion by a resonating conventional one-wavelength loop antenna structure. Since the one-wavelength resonant mode of the conventional loop antenna is a balanced mode, the intensity of surface current distribution excited on the ground conductor portion would be relatively weaker, and the radiating energy of the antenna would be mainly contributed by the loop antenna structure. However, a drawback of this architecture would be large sizes of the antenna structure, which results in difficulties for practical applications when integrated and applied into a multi-antenna system operated in lower frequency bands. Moreover, issues such as mutual energy coupling and isolation would become critical between antenna structures of the designed multi-antenna system, and a larger separation distance between the antenna structures would also be needed, which would greatly increase the required overall size of the multi-antenna system.

Figure 3B:
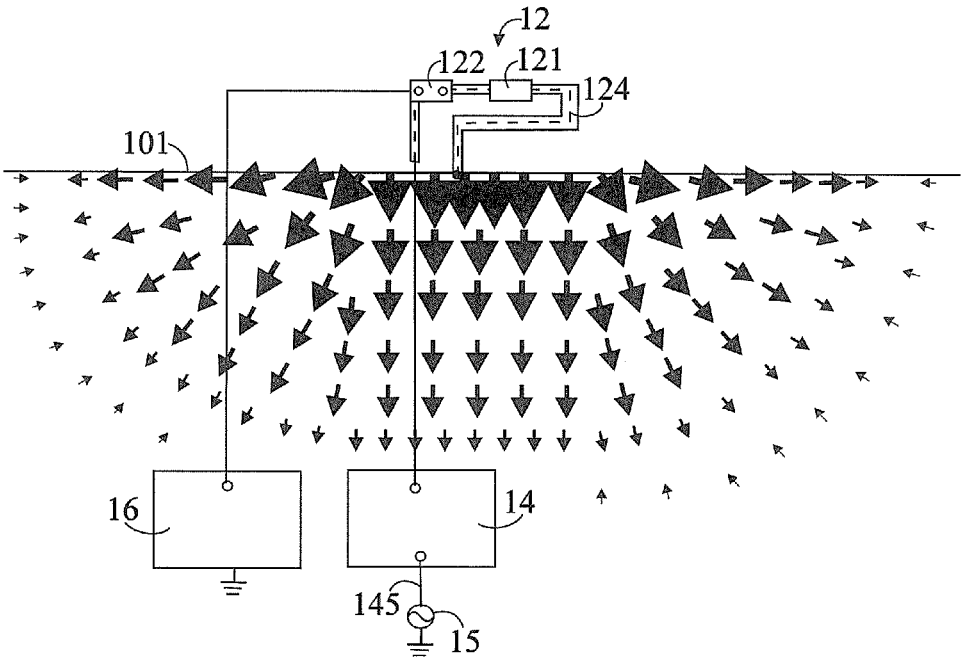
FIG. 3B is a schematic view of the radiation principles of a resonant portion according to an embodiment of the disclosure.

With reference to FIG. 3B, a schematic view is provided illustrating density situation of a surface current distribution excited on a ground conductor portion when the first resonant portion 12 resonates according to an embodiment of the disclosure. In the present embodiment, the first resonant portion 12 excites the first radiating edge 101 and forms the strong surface current distribution, and accordingly the first radiating edge 101 generates a first effective radiating energy and at least one first resonant mode covering at least one first operating band. Therefore, the antenna radiating energy of the present embodiment would be mainly contributed by the first radiating edge 101, and not by the loop resonant structure of the first resonant portion 12. The first resonant path 124 of the first resonant portion 12 is less than or equal to 0.18 times the wavelength of the lowest operating frequency of the multi-antenna system 11, and therefore a great reduction of overall sizes of the multi-antenna system 11 would be achieved successfully. Moreover, by exploiting orthogonal characteristics of the structures of different neighboring radiating edges, the degree of mutual energy coupling between the resonant portions could be effectively decreased, and resonant portions of the multi-antenna system 11 could be further isolated from each other, thereby reducing more of the overall sizes of the multi-antenna system 11.

Figure 4:
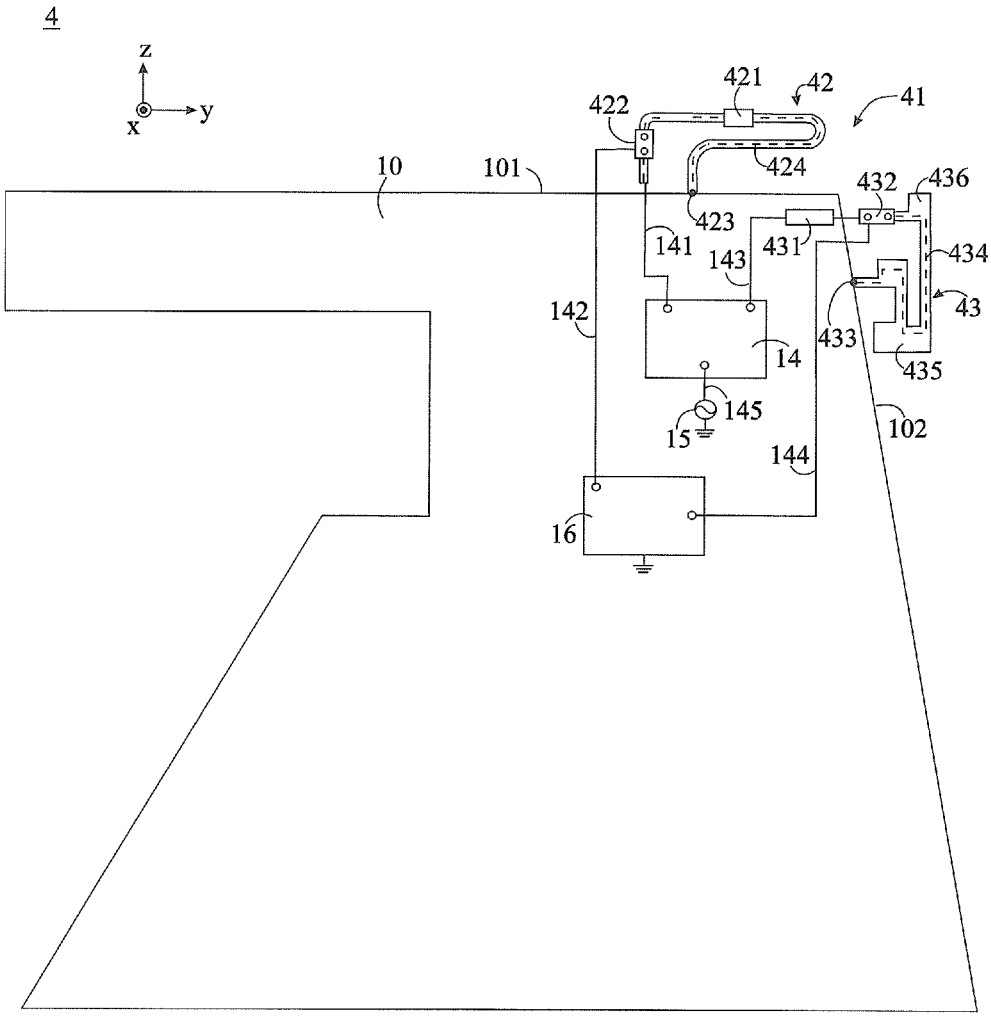
FIG. 4 is a structural schematic view of a communication device 4 and a multi-antenna system 41 thereof according to an embodiment of the disclosure.

With reference to FIG. 4, a structural schematic view of a communication device 4 and a multi-antenna system 41 thereof according to an embodiment of the disclosure is provided. The communication device 4 includes at least a ground conductor portion 10 and the multi-antenna system 41. The ground conductor portion 10 includes at least a first radiating edge 101 and a second radiating edge 102. The multi-antenna system 41 includes at least a first resonant portion 42, a second resonant portion 43, a first control circuit 14, and a second control circuit 16. The first resonant portion 42 is disposed on the first radiating edge 101 of the ground conductor portion 10, and the first resonant portion 42 includes a first electrically coupling portion 421 and a first switch 422. The first resonant portion 42 may have a loop resonant structure having a shorting point 423 and a first resonant path 424. The first switch 422 is disposed on the first resonant path 424. The first electrically coupling portion 421 makes the length of the first resonant path 424 less than or equal to 0.18 times the wavelength of the lowest operating frequency of the multi-antenna system 41, thereby exciting the first radiating edge 101 to form a strong surface current distribution. Moreover, a first effective radiating energy and at least one first resonant mode covering at least one first operating band are generated, and the first effective radiating energy generated has a first strongest radiation direction. The second resonant portion 43 is disposed on the second radiating edge 102 of the ground conductor portion 10. The second resonant portion 43 includes a second electrically coupling portion 431 and a second switch 432, in which the second resonant portion 43 may have a loop resonant structure having a shorting point 433 and a second resonant path 434. The second switch 432 is disposed on the second resonant path 434. The second resonant path 434 further has a protruded portion 435 and a protruded portion 436. The second electrically coupling portion 431 makes the length of the second resonant path 434 less than or equal to 0.18 times the wavelength of the lowest operating frequency of the multi-antenna system 41, thereby exciting the second radiating edge 102 to form a strong surface current distribution. Moreover, a second effective radiating energy and at least one second resonant mode covering the at least one first operating band are generated, and the second effective radiating energy generated has a second strongest radiation direction. Furthermore, the first or second electrically coupling portion 421 or 431 includes at least one lumped capacitive element, variable capacitive element, or distributive capacitive conductor structure. In addition, the capacitive elements or capacitive conductor structures included in the first or second electrically coupling portion 421 or 431 have at least one coupling spacing, in which the gap of the coupling spacing is less than 0.01 times the wavelength of the lowest operating frequency of the multi-antenna system 41.

In the communication device 4 of the present embodiment, the first radiating edge 101 is adjacent to the second radiating edge 102, and the two edges serve as two sides of the ground conductor portion 10. The first control circuit 14 is respectively electrically coupled to the first resonant portion 42 and the second resonant portion 43 through the signal lines 141 and 143, and the first control circuit 14 is electrically connected to a signal source 15 through a signal line 145. The first control circuit 14 may switch the signal source 15 to electrically couple to one of the first resonant portion 42 or the second resonant portion 43 and generate the first strongest radiation direction or the second strongest radiation direction. Alternatively, the first control circuit 14 may control the signal source 15 to concurrently and electrically couple to the first resonant portion 42 and the second resonant portion 43 and generate a third effective radiating energy having a third strongest radiation direction, in which an included angle between the first and second strongest radiation directions is at least 30 degrees. The signal source 15 may be a RF module, a RF circuit, a RF chip, a RF filter, or a RF switch.

In the communication device 4 of the present embodiment, the second control circuit 16 is respectively and electrically coupled to the first switch 422 and the second switch 432 through the signal lines 142 and 144. The second control circuit 16 may switch the first switch 422 to a conducting state when the signal source 15 is electrically coupled to the first resonant portion 42, and the second control circuit 16 may switch the second switch 432 to the conducting state when the signal source 15 is electrically coupled to the second resonant portion 43. The first or second switch 422 or 432 may be a diode element, a capacitive switch element, an integrated circuit switch element, or a MEMS switch element.

In the communication device 4 of the present embodiment, when the signal source 15 is not electrically coupled to the first resonant portion 42, the first switch 422 is in an open state, thereby effectively preventing the strong surface current distribution excited by the second resonant portion 43 on the ground conductor portion 10 to cause the first resonant portion 42 to resonate. Accordingly, the effects of the first resonant portion 42 on the second strongest radiation direction could be reduced. When the signal source 15 is not electrically coupled to the second resonant portion 43, the second switch 432 is in the open state, thereby effectively preventing the strong surface current distribution excited by the first resonant portion 42 on the ground conductor portion 10 to cause the second resonant portion 43 to resonate. Accordingly, the effects of the second resonant portion 43 on the first strongest radiation direction could be reduced, and the included angle between the first and second strongest radiation directions could be increased.

In the communication device 4 of the present embodiment, although the loop resonant structures of the first resonant portion 42 and the second resonant portion 43 are not the same, the loop resonant path of the second resonant portion 43 has the protruded portion 435 and the protruded portion 436. Moreover, the configuration of the first electrically coupling portion 421 and the first switch 422 on the first resonant portion 42 is different from the configuration of the second electrically coupling portion 431 and the second switch 432 on the second resonant portion 43. The shape of the ground conductor portion 10 is also different from the embodiment of the communication device 1. However, since both of the first and the second electrically coupling portions 421 and 431 could make the lengths of the loop resonant paths 424 and 434 less than or equal to 0.18 times the wavelength of the lowest operating frequency of the multi-antenna system 41, therefore, the first and second resonant portions 42 and 43 could excite the first and second radiating edges 101 and 102 to form strong surface current distributions and generate the first and second effective radiating energies. Accordingly, by using the first and second control circuits 14 and 16 to switch and adjust the electrical coupling states of the signal source 15 with the first and second resonant portions 42 and 43, the similar performances from the embodiment of the communication device 1 including the reduction of the overall size of the multi-antenna system and switchable antenna radiation patterns could also be achieved.

Figure 5:
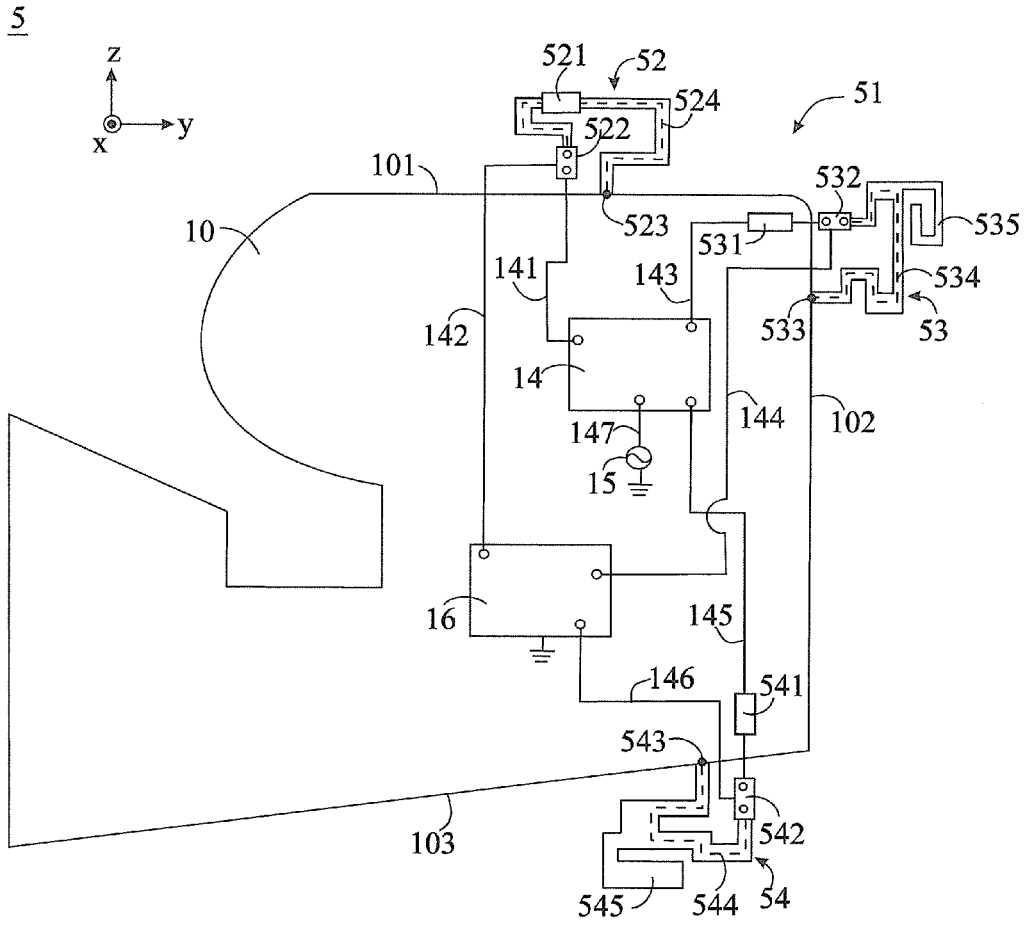
FIG. 5 is a structural schematic view of a communication device 5 and a multi-antenna system 51 thereof according to an embodiment of the disclosure.

With reference to FIG. 5, a structural schematic view of a communication device 5 and a multi-antenna system 51 thereof according to an embodiment of the disclosure is provided. The communication device 5 includes at least a ground conductor portion 10 and the multi-antenna system 51. The ground conductor portion 10 includes at least a first radiating edge 101 and a second radiating edge 102. The multi-antenna system 51 includes at least a first resonant portion 52, a second resonant portion 53, a first control circuit 14, and a second control circuit 16. The first resonant portion 52 is disposed on the first radiating edge 101 of the ground conductor portion 10, and the first resonant portion 52 includes a first electrically coupling portion 521 and a first switch 522. The first resonant portion 52 may have a loop resonant structure having a shorting point 523 and a first resonant path 524. The first switch 522 is disposed on the first resonant path 524. The first electrically coupling portion 521 makes the length of the first resonant path 524 less than or equal to 0.18 times the wavelength of the lowest operating frequency of the multi-antenna system 51, thereby exciting the first radiating edge 101 to foil a strong surface current distribution. Moreover, a first effective radiating energy and at least one first resonant mode covering at least one first operating band are generated, and the first effective radiating energy generated has a first strongest radiation direction. The second resonant portion 53 is disposed on the second radiating edge 102 of the ground conductor portion 10. The second resonant portion 53 includes a second electrically coupling portion 531 and a second switch 532, in which the second resonant portion 53 may have a loop resonant structure having a shorting point 533 and a second resonant path 534. The second switch 532 is disposed on the second resonant path 534. The second resonant path 534 further has a protruded portion 535. The second electrically coupling portion 531 makes the length of the second resonant path 534 less than or equal to 0.18 times the wavelength of the lowest operating frequency of the multi-antenna system 51, thereby exciting the second radiating edge 102 to form a strong surface current distribution. Moreover, a second effective radiating energy and at least one second resonant mode covering the at least one first operating band are generated, and the second effective radiating energy generated has a second strongest radiation direction. Furthermore, the first or second electrically coupling portion 521 or 531 includes at least one lumped capacitive element, variable capacitive element, or distributive capacitive conductor structure. In addition, the capacitive elements or capacitive conductor structures included in the first or second electrically coupling portion 521 or 531 have at least one coupling spacing, in which the gap of the coupling spacing is less than 0.01 times the wavelength of the lowest operating frequency of the multi-antenna system 51.

In the communication device 5 of the present embodiment, the first radiating edge 101 is adjacent to the second radiating edge 102, and the two edges serve as two sides of the ground conductor portion 10. The first control circuit 14 is respectively electrically coupled to the first resonant portion 52 and the second resonant portion 53 through the signal lines 141 and 143, and the first control circuit 14 is electrically connected to a signal source 15 through a signal line 147. The first control circuit 14 may switch the signal source 15 to electrically couple to one of the first resonant portion 52 or the second resonant portion 53 and generate the first strongest radiation direction or the second strongest radiation direction. Alternatively, the first control circuit 14 may control the signal source 15 to concurrently and electrically couple to the first resonant portion 52 and the second resonant portion 53 and generate a third effective radiating energy having a third strongest radiation direction, in which an included angle between the first and second strongest radiation directions is at least 30 degrees.

In the communication device 5 of the present embodiment, the second control circuit 16 is respectively and electrically coupled to the first switch 522 and the second switch 532 through the signal lines 142 and 144. The second control circuit 16 may switch the first switch 522 to a conducting state when the signal source 15 is electrically coupled to the first resonant portion 52, and the second control circuit 16 may switch the second switch 532 to the conducting state when the signal source 15 is electrically coupled to the second resonant portion 53. The first or second switch 522 or 532 may be a diode element, a capacitive switch element, an integrated circuit switch element, or a MEMS switch element.

In the communication device 5 of the present embodiment, when the signal source 15 is not electrically coupled to the first resonant portion 52, the first switch 522 is in an open state, thereby effectively preventing the strong surface current distribution excited by the second resonant portion 53 on the ground conductor portion 10 to cause the first resonant portion 52 to resonate. Accordingly, the effects of the first resonant portion 52 on the second strongest radiation direction can be reduced. When the signal source 15 is not electrically coupled to the second resonant portion 53, the second switch 532 is in the open state, thereby effectively preventing the strong surface current distribution excited by the first resonant portion 52 on the ground conductor portion 10 to cause the second resonant portion 53 to resonate. Accordingly, the effects of the second resonant portion 53 on the first strongest radiation direction can be reduced, and the included angle between the first and second strongest radiation directions can be increased. The signal source 15 may be a RF module, a RF circuit, a RF chip, a RF filter, or a RF switch.

In the communication device 5 of the present embodiment, a third radiating edge 103 near the second radiating edge 102 is used for designing a third resonant portion 54 disposed on the third radiating edge 103. The third resonant portion 54 includes a third electrically coupling portion 541 and a third switch 542. The third resonant portion 54 may have a loop resonant structure having a shorting point 543 and a third resonant path 544. The third switch 542 is disposed on the third resonant path 544. The third resonant path 544 further has a protruded portion 545. The third electrically coupling portion 541 makes the length of the third resonant path 544 less than or equal to 0.18 times the wavelength of the lowest operating frequency of the multi-antenna system 51, thereby exciting the third radiating edge 103 to foam a strong surface current distribution. Moreover, a fourth effective radiating energy and at least one third resonant mode covering the at least one first operating band are generated, and the fourth effective radiating energy generated has a fourth strongest radiation direction. Furthermore, the third electrically coupling portion 541 includes at least one lumped capacitive element, variable capacitive element, or distributive capacitive conductor structure. In addition, the capacitive elements or capacitive conductor structures included in the third electrically coupling portion 541 have at least one coupling spacing, in which the gap of the coupling spacing is less than 0.01 times the wavelength of the lowest operating frequency of the multi-antenna system 51.

In the communication device 5 of the present embodiment, the first control circuit 14 is electrically coupled to the third resonant portion 54 through the signal line 145. The first control circuit 14 may switch the signal source 15 to electrically couple to the third resonant portion 54 and generate the fourth strongest radiation direction. Alternatively, the first control circuit 14 may control the signal source 15 to concurrently and electrically couple to the first resonant portion 52 and the second resonant portion 53 and generate a third effective radiating energy having a third strongest radiation direction. Alternatively, the first control circuit 14 may control the signal source 15 to concurrently and electrically couple to the second resonant portion 53 and the third resonant portion 54 and generate a fifth effective radiating energy having a fifth strongest radiation direction. The second control circuit 16 is electrically coupled to the third switch 542 through the signal line 146. The second control circuit 16 may switch the third switch 542 to a conducting state when the signal source 15 is electrically coupled to the third resonant portion 54. The third switch 542 may be a diode element, a capacitive switch element, an integrated circuit switch element, or a MEMS switch element. When the signal source 15 is not electrically coupled to the third resonant portion 54, the third switch 542 is in an open state, thereby effectively preventing the strong surface current distribution excited by the second resonant portion 53 on the ground conductor portion 10 to cause the third resonant portion 54 to resonate. Accordingly, the effects of the second resonant portion 53 on the fourth strongest radiation direction could be reduced. Moreover, an included angle between the second and fourth strongest radiation directions could be increased, in which the included angle between the second and fourth strongest radiation directions is at least 30 degrees.

In the communication device 5 of the present embodiment, the disclosure describes that a plurality of resonant portions may be designed on different adjacent radiating edges of the ground conductor portion 10 in order to achieve more switchable antenna patterns. Although an additional third resonant portion 54 is designed, the loop resonant structures of the first resonant portion 52, the second resonant portion 53, and the third resonant portion 54 are not the same. The loop resonant path 534 of the second resonant portion 53 has the protruded portion 535, and the loop resonant path 544 of the third resonant portion 54 has the protruded portion 545. Moreover, the shape of the ground conductor portion 10 is also different from the embodiments of the communication device 1 and the communication device 4. However, due to the first electrically coupling portion 521, the second electrically coupling portion 531, and the third electrically coupling portion 541, the lengths of the loop resonant paths 524, 534, and 544 are also made to be less than or equal to 0.18 times the wavelength of the lowest operating frequency of the multi-antenna system 51. Therefore, the first radiating edge 101, the second radiating edge 102, and the third radiating edge 103 are also excited to form strong surface current distributions and generate the first, second, and fourth effective radiating energies. Accordingly, by using the first and second control circuits 14 and 16 to switch and adjust the electrical coupling states of the signal source 15 with the first, second, and third resonant portions 52, 53, and 54, the same effects from the embodiment of the communication device 1 including the reduction of the overall size of the multi-antenna system and switchable antenna radiation patterns can be achieved.

Figure 6:
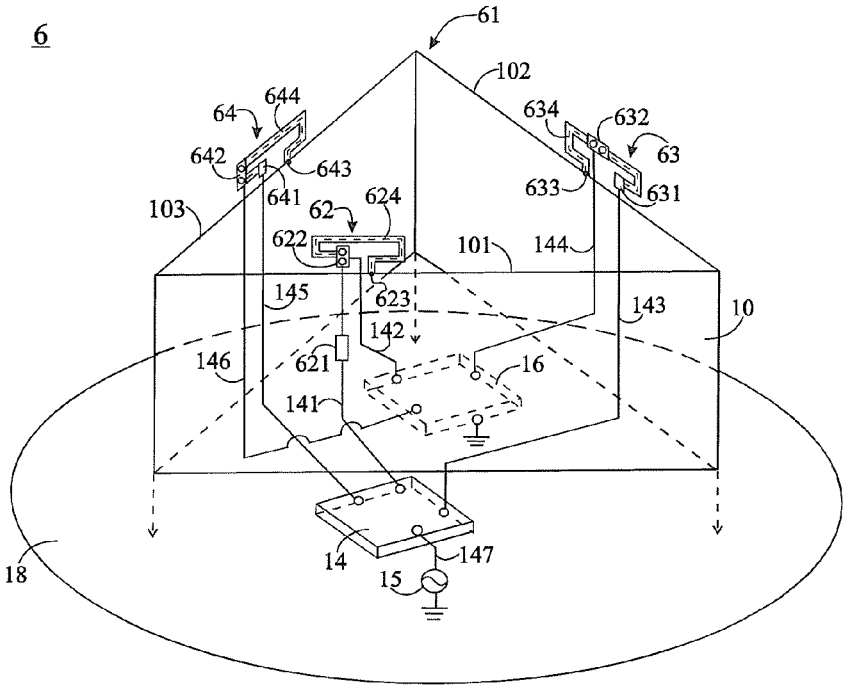
FIG. 6 is a structural schematic view of a communication device 6 and a multi-antenna system 61 thereof according to an embodiment of the disclosure.

With reference to FIG. 6, it illustrates a method for designing a multi-antenna system adapted for implementing a communication device 6 according to an embodiment of the disclosure. The method includes the following steps. A multi-antenna system 61 is disposed in the communication device 6 including a ground conductor portion 10, in which the ground conductor portion 10 includes at least a first radiating edge 101 and a second radiating edge 102. The multi-antenna system 61 includes at least a first resonant portion 62 and a second resonant portion 63. The first resonant portion 62 is disposed on the first radiating edge 101, in which the first resonant portion 62 includes a loop resonant structure having a shorting point 623 and a first resonant path 624. The first resonant portion 62 also has a first electrical coupling portion 621 and a first switch 622. The first switch 622 is disposed on the first resonant path 624. The first electrically coupling portion 621 makes the length of the first resonant path 624 less than or equal to 0.18 times the wavelength of the lowest operating frequency of the multi-antenna system 61, the first electrically coupling portion 621 causing the first resonant portion 62 to excite the first radiating edge 101 to form a strong surface current distribution. Moreover, a first effective radiating energy and at least one first resonant mode covering at least one first operating band are generated, and the first effective radiating energy generated has a first strongest radiation direction. The second resonant portion 63 is disposed on the second radiating edge 102, in which the second resonant portion 63 includes a second electrically coupling portion 631 and a second switch 632, in which the second resonant portion 63 includes a loop resonant structure having a shorting point 633 and a second resonant path 634. The second resonant portion 63 also has a second electrical coupling portion 631 and a second switch 632. The second switch 632 is disposed on the second resonant path 634. The second electrically coupling portion 631 makes the length of the second resonant path 634 less than or equal to 0.18 times the wavelength of the lowest operating frequency of the multi-antenna system 61, the second electrically coupling portion 631 causing the second resonant portion 63 to excite the second radiating edge 102 to form a strong surface current distribution. Moreover, a second effective radiating energy and at least one second resonant mode covering at least one first operating band are generated, and the second effective radiating energy generated has a second strongest radiation direction. A first control circuit 14 is disposed, the first control circuit 14 is respectively and electrically coupled to the first resonant portion 62 and the second resonant portion 63 through the signal lines 141 and 143, and the first control circuit 14 is electrically connected to a signal source 15 through a signal line 147. The first control circuit 14 may switch the signal source 15 to electrically couple to one of the first resonant portion 62 or the second resonant portion 63 and generate the first strongest radiation direction or the second strongest radiation direction. Alternatively, the first control circuit 14 may control the signal source 15 to concurrently and electrically couple to the first resonant portion 62 and the second resonant portion 63 and generate a third effective radiating energy having a third strongest radiation direction, in which an included angle between the first and second strongest radiation directions is at least 30 degrees. A second control circuit 16 is disposed, and the second control circuit 16 is respectively and electrically coupled to the first switch 622 and the second switch 632 through the signal lines 142 and 144. The second control circuit 16 may switch the first switch 622 to a conducting state when the signal source 15 is electrically coupled to the first resonant portion 62, and the second control circuit 16 may switch the second switch 632 to the conducting state when the signal source 15 is electrically coupled to the second resonant portion 63. The signal source 15 may be a RF module, a RF circuit, a RF chip, a RF filter, or a RF switch.

In the communication device 6 of the present embodiment, the first radiating edge 101 is adjacent to the second radiating edge 102, and the two edges serve as two sides of the ground conductor portion 10. Furthermore, the first or second electrically coupling portion 621 or 631 includes at least one lumped capacitive element, variable capacitive element, or distributive capacitive conductor structure. In addition, the capacitive elements or capacitive conductor structures included in the first or second electrically coupling portion 621 or 631 have at least one coupling spacing, in which the gap of the coupling spacing is less than 0.01 times the wavelength of the lowest operating frequency of the multi-antenna system 61. The first or second switch 622 or 632 may be a diode element, a capacitive switch element, an integrated circuit switch element, or a MEMS switch element.

In the communication device 6 of the present embodiment, when the signal source 15 is not electrically coupled to the first resonant portion 62, the first switch 622 is in an open state, thereby effectively preventing the strong surface current distribution excited by the second resonant portion 63 on the ground conductor portion 10 to cause the first resonant portion 62 to resonate. Accordingly, the effects of the first resonant portion 62 on the second strongest radiation direction could be reduced. When the signal source 15 is not electrically coupled to the second resonant portion 63, the second switch 632 is in the open state, thereby effectively preventing the strong surface current distribution excited by the first resonant portion 62 on the ground conductor portion 10 to cause the second resonant portion 63 to resonate. Accordingly, the effects of the second resonant portion 63 on the first strongest radiation direction could be reduced, and the included angle between the first and second strongest radiation directions could be increased.

In the communication device 6 of the present embodiment, the ground conductor portion 10 is a trihedral three-dimensional (3D) structure having a third radiating edge 103 adjacent to the first radiating edge 101 and the second radiating edge 102. The ground conductor portion 10 is disposed on another ground conductor structure 18. In the communication device 6 of the present embodiment, the third radiating edge 103 is used to design and configure a third resonant portion 64 including a third electrically coupling portion 641 and a third switch 642. The third resonant portion 64 includes a loop resonant structure having a shorting point 643 and a third resonant path 644. The third switch 642 is disposed on the third resonant path 644. The third electrically coupling portion 641 makes the length of the third resonant path 644 less than or equal to 0.18 times the wavelength of the lowest operating frequency of the multi-antenna system 61, thereby exciting the third radiating edge 103 to form a strong surface current distribution. Moreover, a fourth effective radiating energy and at least one third resonant mode covering at least one first operating band are generated, and the fourth effective radiating energy generated has a fourth strongest radiation direction. The third electrically coupling portion 641 includes at least one lumped capacitive element, variable capacitive element, or distributive capacitive conductor structure. In addition, the capacitive elements or capacitive conductor structures included in the third electrically coupling portion 641 have at least one coupling spacing, in which the gap of the coupling spacing is less than 0.01 times the wavelength of the lowest operating frequency of the multi-antenna system 61.

In the communication device 6 of the present embodiment, the first control circuit 14 is electrically coupled to the third resonant portion 64 through the signal line 145. The first control circuit 14 may switch the signal source 15 to electrically couple to the third resonant portion 64 and generate the fourth strongest radiation direction. Alternatively, the first control circuit 14 may control the signal source 15 to concurrently and electrically couple to the first resonant portion 62 and the second resonant portion 63 and generate a third effective radiating energy having a third strongest radiation direction. Alternatively, the first control circuit 14 may control the signal source 15 to concurrently and electrically couple to the second resonant portion 63 and the third resonant portion 64 and generate a fifth effective radiating energy having a fifth strongest radiation direction. The second control circuit 16 is electrically coupled to the third switch 642 through the signal line 146. The second control circuit 16 may switch the third switch 642 to a conducting state when the signal source 15 is electrically coupled to the third resonant portion 64. The third switch 642 may be a diode element, a capacitive switch element, an integrated circuit switch element, or a MEMS switch element. When the signal source 15 is not electrically coupled to the third resonant portion 64, the third switch 642 is in an open state, thereby effectively preventing the strong surface current distribution excited by the second resonant portion 63 on the ground conductor portion 10 to cause the third resonant portion 64 to resonate. Accordingly, the effects of the second resonant portion 63 on the fourth strongest radiation direction can be reduced. Moreover, an included angle between the second and fourth strongest radiation directions could be increased, in which the included angle between the second and fourth strongest radiation directions is at least 30 degrees. In addition, it could also effectively prevent the strong surface current distribution excited by the first resonant portion 62 on the ground conductor portion 10 causing the third resonant portion 64 to resonate. Accordingly, the effects of the first resonant portion 62 on the fourth strongest radiation direction could be reduced. Moreover, an included angle between the first and fourth strongest radiation directions could be increased, in which the included angle between the first and fourth strongest radiation directions is at least 30 degrees.

In the communication device 6 of the present embodiment, the methods for designing the multi-antenna system in the disclosure may be used to implement the communication device 6. Moreover, by designing a plurality of resonant portions on different adjacent radiating edges of the ground conductor portion 10, the design methods in the disclosure could achieve more reconfigurable antenna patterns. In the communication device 6 of the present embodiment, the configurations of the electrically coupling portions 621, 631, and 641 and the switches 622, 632, and 642 on the first, second, and third resonant portions 62, 63, and 64 are not the same, and the ground conductor portion is a 3D structure having a different shape from the embodiments of the communication devices 1, 4, and 5. However, due to the first electrically coupling portion 621, the second electrically coupling portion 631, and the third electrically coupling portion 641, the lengths of the loop resonant paths 624, 634, and 644 are also made to be less than or equal to 0.18 times the wavelength of the lowest operating frequency of the multi-antenna system 61. Therefore, the first radiating edge 101, the second radiating edge 102, and the third radiating edge 103 are also excited to form strong surface current distributions and generate the first, second, and fourth effective radiating energies. Accordingly, by using the first and second control circuits 14 and 16 to switch and adjust the electrical coupling states of the signal source 15 with the first, second, and third resonant portions 62, 63, and 64, the same effects from the embodiment of the communication device 1 including the reduction of the overall size of the multi-antenna system and switchable antenna radiation patterns can be achieved.

Figure 7:
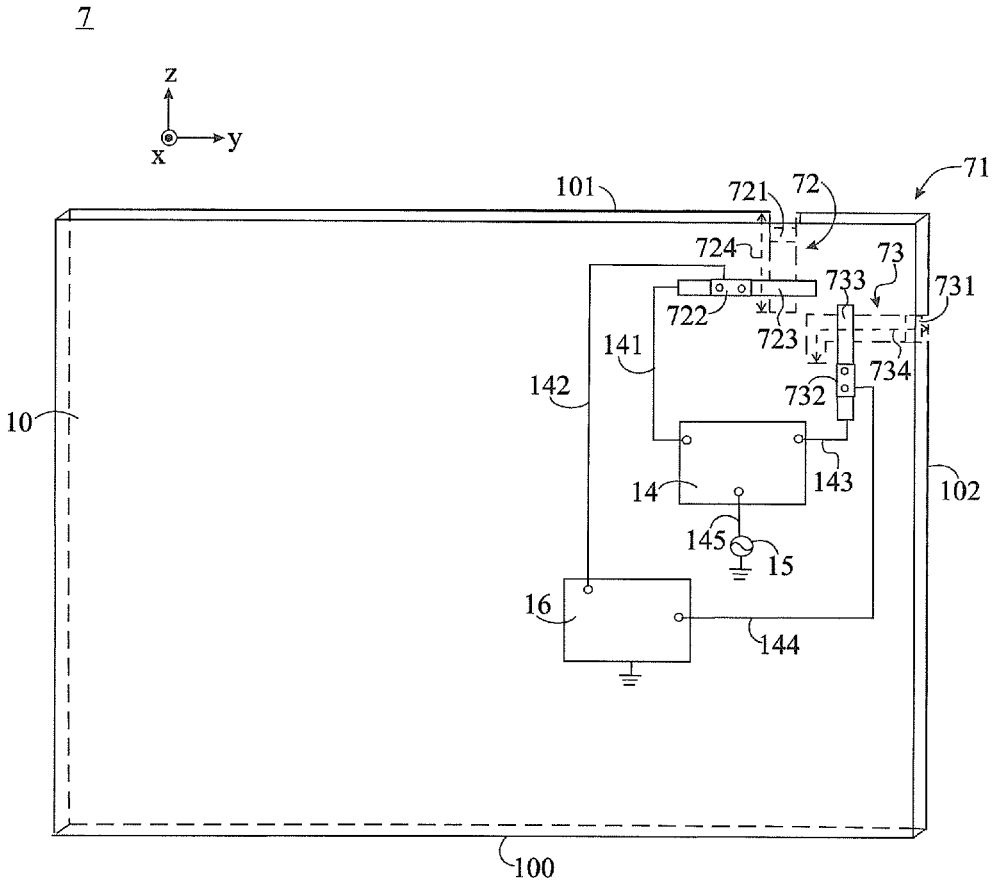
FIG. 7 is a structural schematic view of a communication device 7 and a multi-antenna system 71 thereof according to an embodiment of the disclosure.

With reference to FIG. 7, a structural schematic view of a communication device 7 and a multi-antenna system 71 thereof according to an embodiment of the disclosure is provided. The communication device 7 includes at least a ground conductor portion 10 and the multi-antenna system 71. The ground conductor portion 10 includes at least a first radiating edge 101 and a second radiating edge 102, which are implemented on a dielectric substrate 100. The multi-antenna system 71 includes at least a first resonant portion 72, a second resonant portion 73, a first control circuit 14, and a second control circuit 16. The first resonant portion 72 is disposed on the first radiating edge 101 of the ground conductor portion 10, and the first resonant portion 72 includes a first electrically coupling portion 721 and a first switch 722. The first resonant portion 72 may have an open-slot resonant structure having a first resonant path 724, and a feeding metal strip 723. The feeding metal strip 723 and the open-slot resonant structure are respectively disposed on different surfaces above and below the dielectric substrate 100. The first electrically coupling portion 721 makes the length of the first resonant path 724 to be less than or equal to 0.18 times the wavelength of the lowest operating frequency of the multi-antenna system 71, thereby exciting the first radiating edge 101 to form a strong surface current distribution. Moreover, a first effective radiating energy and at least one first resonant mode covering at least one first operating band are generated, and the first effective radiating energy generated has a first strongest radiation direction. The second resonant portion 73 is disposed on the second radiating edge 102 of the ground conductor portion 10, and the second resonant portion 73 includes a second electrically coupling portion 731 and a second switch 732. The second resonant portion 73 may have an open-slot resonant structure having a second resonant path 734, and a feeding metal strip 733. The feeding metal strip 733 and the open-slot resonant structure are respectively disposed on different surfaces above and below the dielectric substrate 100. The second electrically coupling portion 731 makes the second resonant path 734 less than or equal to 0.18 times the wavelength of the lowest operating frequency of the multi-antenna system 71, thereby exciting the second radiating edge 102 to form a strong surface current distribution. Moreover, a second effective radiating energy and at least one second resonant mode covering at least one first operating band are generated, and the second effective radiating energy generated has a second strongest radiation direction. Furthermore, the first or second electrically coupling portion 721 or 731 includes at least one lumped capacitive element, variable capacitive element, or distributive capacitive conductor structure. In addition, the capacitive elements or capacitive conductor structures included in the first or second electrically coupling portion 721 or 731 have at least one coupling spacing, in which the coupling spacing is less than 0.01 times the wavelength of the lowest operating frequency of the multi-antenna system 71.

In the communication device 7 of the present embodiment, the first radiating edge 101 is adjacent to the second radiating edge 102, and the two edges serve as two sides of the ground conductor portion 10. The first control circuit 14 is respectively and electrically coupled to the feeding metal strips 723 and 733 through the signal lines 141 and 143, and the first control circuit 14 is electrically connected to a signal source 15 through a signal line 145. The first control circuit 14 may switch the signal source 15 to electrically couple to one of the first resonant portion 72 or the second resonant portion 73 and generate the first strongest radiation direction or the second strongest radiation direction. Alternatively, the first control circuit 14 may control the signal source 15 to concurrently and electrically couple to the first resonant portion 72 and the second resonant portion 73 and generate a third effective radiating energy having a third strongest radiation direction, in which an included angle between the first and second strongest radiation directions is at least 30 degrees. The signal source 15 may be a RF module, a RF circuit, a RF chip, a RF filter, or a RF switch.

In the communication device 7 of the present embodiment, the second control circuit 16 is respectively and electrically coupled to the first switch 722 and the second switch 732 through the signal lines 142 and 144. The second control circuit 16 may switch the first switch 722 to a conducting state when the signal source 15 is electrically coupled to the first resonant portion 72. Moreover, the second control circuit 16 may switch the second switch 732 to the conducting state when the signal source 15 is electrically coupled to the second resonant portion 73. The first switch 722 or the second switch 732 may be a diode element, a capacitive switch element, an integrated circuit switch element, or a MEMS switch element.

In the communication device 7 of the present embodiment, when the signal source 15 is not electrically coupled to the first resonant portion 72, the first switch 722 is in an open state, thereby effectively preventing the strong surface current distribution excited by the second resonant portion 73 on the ground conductor portion 10 to cause the first resonant portion 72 to resonate. Accordingly, the effects of the first resonant portion 72 on the second strongest radiation direction can be reduced.

When the signal source 15 is not electrically coupled to the second resonant portion 73, the second switch 732 is in the open state, thereby effectively preventing the strong surface current distribution excited by the first resonant portion 72 on the ground conductor portion 10 to cause the second resonant portion 73 to resonate. Accordingly, the effects of the second resonant portion 73 on the first strongest radiation direction can be reduced, and an included angle between the first and second strongest radiation directions can be increased.

In the communication device 7 of the present embodiment, the first resonant portion 72 and the second resonant portion 73 are open-slot resonant structures, which are different than the loop resonant structures of the communication devices 1, 4, 5, and 6. Moreover, the shape of the ground conductor portion 10 is also different from the embodiments of the communication devices 1, 4, 5, and 6. However, due to the first electrically coupling portion 721 and the second electrically coupling portion 731, the lengths of the first and second resonant paths 724 and 734 are also made to be less than or equal to 0.18 times the wavelength of the lowest operating frequency of the multi-antenna system 71. Therefore, the first radiating edge 101 and the second radiating edge 102 are also excited to form strong surface current distributions and generate the first and second effective radiating energies. Accordingly, by using the first and second control circuits 14 and 16 to switch and adjust the electrical coupling states of the signal source 15 with the first and second resonant portions 72 and 73, the same effects from the embodiment of the communication device 1 including the reduction of the overall size of the multi-antenna system and switchable antenna radiation patterns can be achieved.

Figure 8:
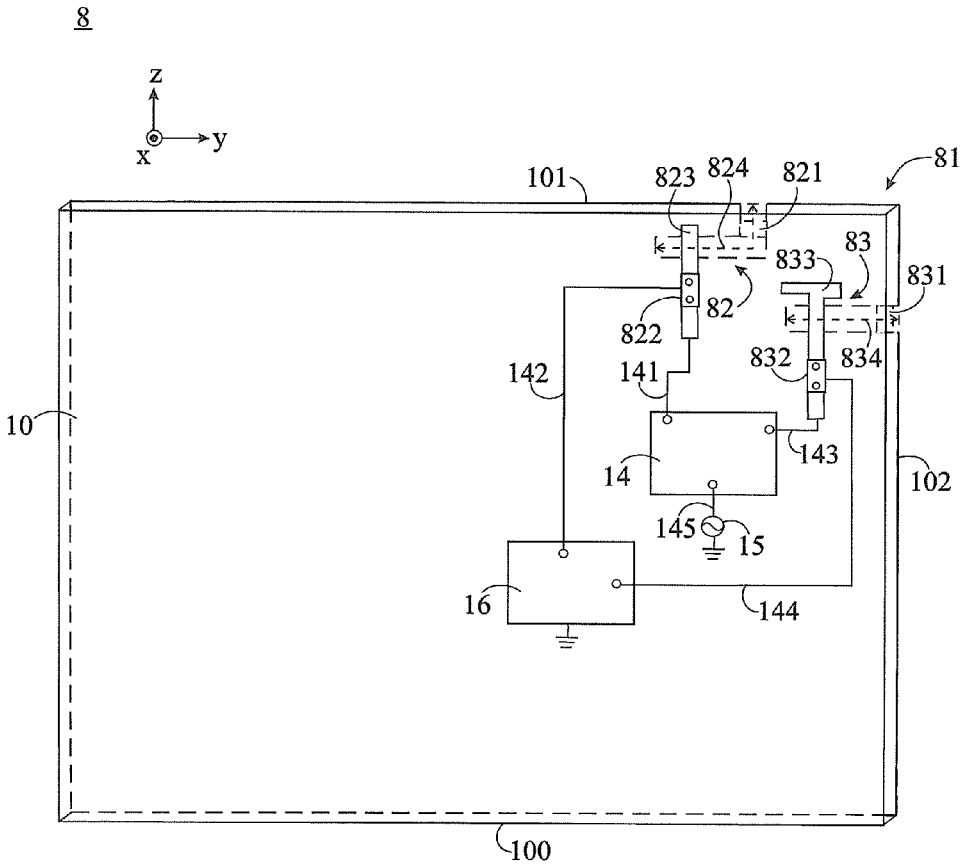
FIG. 8 is a structural schematic view of a communication device 8 and a multi-antenna system 81 thereof according to an embodiment of the disclosure.

With reference to FIG. 8, a structural schematic view of a communication device 8 and a multi-antenna system 81 thereof according to an embodiment of the disclosure is provided. The communication device 8 includes at least a ground conductor portion 10 and the multi-antenna system 81. The ground conductor portion 10 includes at least a first radiating edge 101 and a second radiating edge 102, which are implemented on a dielectric substrate 100. The multi-antenna system 81 includes at least a first resonant portion 82, a second resonant portion 83, a first control circuit 14, and a second control circuit 16. The first resonant portion 82 is disposed on the first radiating edge 101 of the ground conductor portion 10, and the first resonant portion 82 includes a first electrically coupling portion 821 and a first switch 822. The first resonant portion 82 may have an open-slot resonant structure having a first resonant path 824, and a feeding metal strip 823. The feeding metal strip 823 and the open-slot resonant structure are respectively disposed on different surfaces above and below the dielectric substrate 100. The first electrically coupling portion 821 makes the length of the first resonant path 824 less than or equal to 0.18 times the wavelength of the lowest operating frequency of the multi-antenna system 81, thereby exciting the first radiating edge 101 to form a strong surface current distribution. Moreover, a first effective radiating energy and at least one first resonant mode covering at least one first operating band are generated, and the first effective radiating energy generated has a first strongest radiation direction. The second resonant portion 83 is disposed on the second radiating edge 102 of the ground conductor portion 10, and the second resonant portion 83 includes a second electrically coupling portion 831 and a second switch 832. The second resonant portion 83 may have an open-slot resonant structure having a second resonant path 834, and a feeding metal strip 833. The feeding metal strip 833 and the open-slot resonant structure are respectively disposed on different surfaces above and below the dielectric substrate 100. The second electrically coupling portion 831 makes the length of the second resonant path 834 less than or equal to 0.18 times the wavelength of the lowest operating frequency of the multi-antenna system 81, thereby exciting the second radiating edge 102 to form a strong surface current distribution. Moreover, a second effective radiating energy and at least one second resonant mode covering at least one first operating band are generated, and the second effective radiating energy generated has a second strongest radiation direction. Furthermore, the first or second electrically coupling portion 821 or 831 includes at least one lumped capacitive element, variable capacitive element, or distributive capacitive conductor structure. In addition, the capacitive elements or capacitive conductor structures included in the first or second electrically coupling portion 821 or 831 have at least one coupling spacing, in which the coupling spacing is less than 0.01 times the wavelength of the lowest operating frequency of the multi-antenna system 81.

In the communication device 8 of the present embodiment, the first radiating edge 101 is adjacent to the second radiating edge 102, and the two edges serve as two sides of the ground conductor portion 10. The first control circuit 14 is respectively electrically coupled to the feeding metal strips 823 and 833 through the signal lines 141 and 143, and the first control circuit 14 is electrically connected to a signal source 15 through a signal line 145. The first control circuit 14 may switch the signal source 15 to electrically couple to one of the first resonant portion 82 or the second resonant portion 83 and generate the first strongest radiation direction or the second strongest radiation direction. Alternatively, the first control circuit 14 may control the signal source 15 to concurrently and electrically couple to the first resonant portion 82 and the second resonant portion 83 and generate a third effective radiating energy having a third strongest radiation direction, in which an included angle between the first and second strongest radiation directions is at least 30 degrees. The signal source 15 may be a RF module, a RF circuit, a RF chip, a RF filter, or a RF switch.

In the communication device 8 of the present embodiment, the second control circuit 16 is respectively and electrically coupled to the first switch 822 and the second switch 832 through the signal lines 142 and 144. The second control circuit 16 may switch the first switch 822 to a conducting state when the signal source 15 is electrically coupled to the first resonant portion 82. Moreover, the second control circuit 16 may switch the second switch 832 to the conducting state when the signal source 15 is electrically coupled to the second resonant portion 83. The first switch 822 or the second switch 832 may be a diode element, a capacitive switch element, an integrated circuit switch element, or a MEMS switch element.

In the communication device 8 of the present embodiment, when the signal source 15 is not electrically coupled to the first resonant portion 82, the first switch 822 is in an open state, thereby effectively preventing the strong surface current distribution excited by the second resonant portion 83 on the ground conductor portion 10 to cause the first resonant portion 82 to resonate. Accordingly, the effects of the first resonant portion 82 on the second strongest radiation direction can be reduced. When the signal source 15 is not electrically coupled to the second resonant portion 83, the second switch 832 is in the open state, thereby effectively preventing the strong surface current distribution excited by the first resonant portion 82 on the ground conductor portion 10 to cause the second resonant portion 83 to resonate. Accordingly, the effects of the second resonant portion 83 on the first strongest radiation direction can be reduced, and an included angle between the first and second strongest radiation directions can be increased.

In the communication device 8 of the present embodiment, the open-slot structures of the first resonant portion 82 and the second resonant portion 83 and the feeding metal strips 823 and 833 are different from the communication device 7. However, due to the first electrically coupling portion 821 and the second electrically coupling portion 831, the lengths of the open-slot resonant paths 824 and 834 are also made to be less than or equal to 0.18 times the wavelength of the lowest operating frequency of the multi-antenna system 81. Therefore, the first radiating edge 101 and the second radiating edge 102 are also excited to form strong surface current distributions and generate the first and second effective radiating energies. Accordingly, by using the first and second control circuits 14 and 16 to switch and adjust the electrical coupling states of the signal source 15 with the first and second resonant portions 82 and 83, the same effects from the embodiment of the communication device 1 including the reduction of the overall size of the multi-antenna system and switchable antenna radiation patterns can be achieved.

It will be apparent to those skilled in the art that various modifications and variations could be made to the disclosed embodiments. It is intended that the specification and examples be considered as exemplary only, with a true scope of the disclosure being indicated by the following claims and their equivalents.

What is claimed is:

1. A communication device, comprising:

a ground conductor portion comprising at least a first radiating edge and a second radiating edge; and a multi-antenna system, comprising at least:

a first resonant portion disposed on the first radiating edge of the ground conductor portion, the first resonant portion comprising a first electrically coupling portion and a first switch, wherein the first resonant portion has a loop resonant structure or an open-slot resonant structure, and the first resonant portion has a first resonant path, the first switch is disposed on the first resonant path, the first electrically coupling portion makes the length of the first resonant path less than or equal to 0.18 times the wavelength of the lowest operating frequency of the multi-antenna system, thereby exciting the first radiating edge to form a strong surface current distribution, and generating a first effective radiating energy and at least one first resonant mode covering at least one first operating band, the first effective radiating energy generated having a first strongest radiation direction;

a second resonant portion disposed on the second radiating edge of the ground conductor portion, the second resonant portion comprising a second electrically coupling portion and a second switch, wherein the second resonant portion has a loop resonant structure or an open-slot resonant structure, and the second resonant portion has a second resonant path, the second switch is disposed on the second resonant path, the second electrically coupling portion makes the length of the second resonant path less than or equal to 0.18 times the wavelength of the lowest operating frequency of the multi-antenna system, thereby exciting the second radiating edge to form a strong surface current distribution, and generating a second effective radiating energy and at least one second resonant mode covering at least the first operating band, the second effective radiating energy generated having a second strongest radiation direction;

a first control circuit respectively and electrically coupled to the first resonant portion and the second resonant portion through a plurality of signal lines, the first control circuit switching a signal source to electrically couple to one of the first resonant portion or the second resonant portion, and generating the first strongest radiation direction or the second strongest radiation direction, or controlling the signal source to concurrently electrically couple to the first resonant portion and the second resonant portion, and generating a third effective radiating energy having a third strongest radiation direction; and a second control circuit respectively and electrically coupled to the first switch and the second switch through a plurality of signal lines, the second control circuit switching the first switch to a conducting state when the signal source is electrically coupled to the first resonant portion, and switching the second switch to the conducting state when the signal source is electrically coupled to the second resonant portion.

2. The communication device of claim 1, wherein each of the first resonant portion and the second resonant portion has a loop resonant structure and a shorting point.

3. The communication device of claim 1, wherein each of the first resonant portion and the second resonant portion has an open-slot resonant structure and a feeding metal strip.

4. The communication device of claim 3, wherein the ground conductor portion is implemented on a surface of a dielectric substrate, and the open-slot resonant structure and the corresponding feeding metal strip are respectively disposed on different surfaces above and below the dielectric substrate.

5. The communication device of claim 1, wherein the first electrically coupling portion or the second electrically coupling portion comprises at least one lumped capacitive element, variable capacitive element, or distributive capacitive conductor structure.

6. The communication device of claim 1, wherein the first switch or the second switch is a diode element, a capacitive switch element, an integrated circuit switch element, or a micro-electro-mechanical system (MEMS) switch element.

7. The communication device of claim 1, wherein the at least one first radiating edge and the second radiating edge serve as two adjacent sides of the ground conductor portion.

8. The communication device of claim 1, wherein when the signal source is not electrically coupled to the first resonant portion, the first switch is in an open state to prevent resonance of the first resonant portion.

9. The communication device of claim 1, wherein when the signal source is not electrically coupled to the second resonant portion, the second switch is in an open state to prevent resonance of the second resonant portion.

10. The communication device of claim 1, wherein an included angle between the first and second strongest radiation directions is at least 30 degrees.

11. A method for designing a multi-antenna system suitable for a communication device, the method comprising:

disposing a multi-antenna system in a communication device comprising a ground conductor portion, wherein the ground conductor portion comprises at least a first radiating edge and a second radiating edge, and the multi-antenna system comprises at least a first resonant portion and a second resonant portion;

disposing the first resonant portion on the first radiating edge, wherein the first resonant portion has a loop resonant structure or an open-slot resonant structure, and the first resonant portion has a first resonant path, the first resonant portion comprising a first electrically coupling portion and a first switch, the first switch is disposed on the first resonant path, the first electrically coupling portion makes the length of the first resonant path less than or equal to 0.18 times the wavelength of the lowest operating frequency of the multi-antenna system, thereby exciting the first radiating edge to form a strong surface current distribution, and generating a first effective radiating energy and at least one first resonant mode covering at least one first operating band, and the first effective radiating energy generated has a first strongest radiation direction;

disposing the second resonant portion on the second radiating edge of the ground conductor portion, wherein the second resonant portion has a loop resonant structure or an open-slot resonant structure, and the second resonant portion has a second resonant path, the second resonant portion comprising a second electrically coupling portion and a second switch, the second switch is disposed on the second resonant path, the second electrically coupling portion makes the length of the second resonant path less than or equal to 0.18 times the wavelength of the lowest operating frequency of the multi-antenna system, thereby exciting the second radiating edge to form a strong surface current distribution, and generating a second effective radiating energy and at least one second resonant mode covering at least the first operating band, the second effective radiating energy generated having a second strongest radiation direction;

disposing a first control circuit respectively electrically coupled to the first resonant portion and the second resonant portion through a plurality of signal lines, the first control circuit switching a signal source to electrically couple to one of the first resonant portion or the second resonant portion, and generating the first strongest radiation direction or the second strongest radiation direction, or controlling the signal source to concurrently and electrically couple to the first resonant portion and the second resonant portion, and generating a third effective radiating energy having a third strongest radiation direction; and disposing a second control circuit respectively and electrically coupled to the first switch and the second switch through a plurality of signal lines, the second control circuit switching the first switch to a conducting state when the signal source is electrically coupled to the first resonant portion, and switching the second switch to the conducting state when the signal source is electrically coupled to the second resonant portion.

12. The method of claim 11, wherein each of the first resonant portion and the second resonant portion has a loop resonant structure and a shorting point.

13. The method of claim 11, wherein each of the first resonant portion and the second resonant portion has an open-slot resonant structure and a feeding metal strip.

14. The method of claim 13, wherein the ground conductor portion is implemented on a surface of a dielectric substrate, and the open-slot resonant structure and the corresponding feeding metal strip are respectively disposed on different surfaces above and below the dielectric substrate.

15. The method of claim 11, wherein the first electrically coupling portion or the second electrically coupling portion comprises at least one lumped capacitive element, variable capacitive element, or distributive capacitive conductor structure.

16. The method of claim 11, wherein the first switch or the second switch is a diode element, a capacitive switch element, an integrated circuit switch element, or a MEMS switch element.

17. The method of claim 11, wherein the at least one first radiating edge and the second radiating edge serve as two adjacent sides of the ground conductor portion.

18. The method of claim 11, wherein when the signal source is not electrically coupled to the first resonant portion, the first switch is in an open state to prevent resonance of the first resonant portion.

19. The method of claim 11, wherein when the signal source is not electrically coupled to the second resonant portion, the second switch is in an open state to prevent resonance of the second resonant portion.

20. The method of claim 11, wherein an included angle between the first and second strongest radiation directions is at least 30 degrees.

* * * * *